US005846048A

United States Patent [19]

Tomita et al.

[11] Patent Number: 5,846,048

[45] Date of Patent: Dec. 8, 1998

[54] GAS TURBINE STATIONARY BLADE UNIT

[75] Inventors: Yasuoki Tomita; Taku Ichiryu, both of Takasago, Japan

[73] Assignee: Mitsubishi Heavy Industries, Ltd., Tokyo, Japan

[21] Appl. No.: 862,146

[22] Filed: May 22, 1997

[51] Int. Cl.[6] ..... F04D 29/38

[52] U.S. Cl. ..... 415/115

[58] Field of Search ..... 415/115, 116, 415/173.1, 173.2, 173.3

[56] References Cited

U.S. PATENT DOCUMENTS

| | | | |
|---|---|---|---|
| 5,273,396 | 12/1993 | Albrecht et al. | 415/115 |
| 5,354,174 | 10/1994 | Balkcum et al. | 415/209.2 |
| 5,380,154 | 1/1995 | Norton et al. | 415/209.2 |
| 5,399,067 | 3/1995 | Yoshida | 415/115 |
| 5,639,210 | 6/1997 | Carpenter et al. | 415/173.3 |
| 5,653,580 | 8/1997 | Faulder et al. | 415/209.3 |
| 5,685,693 | 11/1997 | Sexton et al. | 415/173.1 |

OTHER PUBLICATIONS

U.S. application Ser. No. 08/862,135, Masahiko Mori et al., filed May 22, 1997 Gas Turbine Moving Blade.

U.S. application Ser. No. 08/862,181 Masanori Yuri et al. filed May 22, 1997 Gas Turbine Hollow Blade.

U.S. application Ser. No. 08/861,517 Eiji Akita et al. filed May 22, 1997 Working Method of a Cooling Air Passage in a Gase Turbine Stationary Blade Shroud, and a Gas Turbine Stationary Blade Shroud Having a Cooling Air Passage.

U.S. application Ser. No. 08/861,539 Kenichiro Takeishi et al. filed May 22, 1997 Steam Cooled Blade.

U.S. application Ser. No. 08/861,753 Yasuoka Tomita et al. filed May 22, 1997 Gas Turbine Moving Blade.

U.S. application Ser. No. 08/862,146 Yasuoki Tomita et al. filed May 22, 1997 Gas Turbine Stationary Blade Unit.

U.S. application Ser. No. 08/862,161 Masahiro Mori et al. filed May 22, 1997 Gas Turbine Rotor.

U.S. application Ser. No. 08/861,518 Yukihiro Hashimoto filed May 22, 1997 Gas Turbine Stationary Blade.

*Primary Examiner*—John T. Kwon

*Attorney, Agent, or Firm*—Wenderoth, Lind & Ponack, L.L.P.

[57] ABSTRACT

Object: Gas turbine blade cooling is generally made by use of air, which has a limitation in enhancement of a thermal efficiency, so steam as a cooling medium is being studied. In a steam cooling method, however, a secure recovery of cooling steam and a secure prevention of leakage is required. The present invention provides a new unit which can satisfy such requirement. Solving means: There are provided a column extending in a radial direction on an outer periphery of a shroud, a supply passage and a recovery passage of a cooling medium within said column and a means for joining a supply tube and a recovery tube of the cooling medium connected to a starting end of said supply passage and a finishing end of said recovery passage, respectively, at a terminal end portion of said column, thereby the cooling medium supplied via the supply tube and the supply passage is recovered securely via the recovery passage and the recovery tube so that no leakage occurs outside, thus an employment of steam etc. as a cooling medium can be realized.

10 Claims, 3 Drawing Sheets

GAS TURBINE STATIONARY BLADE UNIT

BACKGROUND OF THE INVENTION

1. Field of the Invention

The present invention relates to a gas turbine stationary blade unit by which a cooling medium supplied for cooling of blades etc. is recovered.

2. Description of the Prior Art

A conventional cooling of gas turbine stationary blades as has so far been taken place is generally such as uses a compressed air, an outline of which is described based on FIG. 3.

FIG. 3 shows flows of such cooling air in the prior art, wherein a discharge air of an air compressor 12 is introduced into a first stage hollow stationary blade 11, in which an impingement cooling or a film cooling is incorporated together, and a bleed air from an interstage of the air compressor 12 is introduced into hollow stationary blades 13, 14, 15 of a second and subsequent stages, both so as to make cooling of the respective stationary blade and then to join in a main gas flow.

Thus, a method in which a portion of the compressed air to be used for combustion is flown into a blade interior or to an opposite gas path side of a shroud to make cooling of metal portions of the blade and the shroud to a temperature below a gas temperature, is generally employed. And the air, after used for cooling or leaked from cooling air passages, is flown to join in the main gas flow and to be discharged, as mentioned above.

In such cooling as uses a cooling air, there is a limitation in a thermal efficiency etc. and a cooling using steam etc. as a cooling medium is now being studied.

One of matters required for such steam cooled blade is to provide a means for recovering steam supplied as a cooling medium, not to allow a leakage of said steam outside of the system and, while satisfying said requirements, to maintain same function as that of the conventional air cooled blade (for example, to hold a blade at a predetermined position against a pressure and a torque reaction force, to minimize a leakage of air at a fitting portion to a turbine casing and a joined portion with a shroud, to secure easiness in overhauling for a periodic inspection etc.).

It is clear that said conventional air cooled blade, as it is, cannot satisfy these requirements, hence a blade of a new construction is required.

SUMMARY OF THE INVENTION

It is therefore an object of the present invention to provide a new blade construction which is able to satisfy such a need.

In order to attain said object, the present invention provides a gas turbine stationary blade unit, having a blade and a shroud provided on an outer periphery of said blade, in which a cooling medium is supplied to flow within said blade and shroud or within said blade and is recovered, wherein there are provided a column extending in a radial direction on an outer periphery of said shroud, a supply passage and a recovery passage of the cooling medium within said column and a means for joining a supply tube and a recovery tube of the cooling medium connected to a starting end of said supply passage and a finishing end of said recovery passage, respectively, at a terminal end portion of said column, thus a column is provided extendingly in a radial direction on an outer periphery of a shroud and, through said column as one base point, a cooling medium is supplied to a blade and shroud or to a blade and is recovered, hence such supply and recovery work is done accurately and securely without leakage and an efficient blade cooling can be done.

Further, the present invention provides a gas turbine stationary blade unit wherein said terminal end portion of said column passes through a hole in a turbine casing or a blade ring, to which said blade is fitted, so as to project on an outer peripheral side of said turbine casing or said blade ring, thus a terminal end portion of a column where a starting end of a cooling medium supply passage and a finishing end of a cooling medium recovery passage collect together is projected on an outer peripheral side, passing through a turbine casing or a blade ring, hence a work for fitting a means for joining a cooling medium supply tube and a cooling medium recovery tube to the terminal end portion of said column can be done at a place where there is a spanner space on the outer peripheral side of the turbine casing or the blade ring and said fitting can be done easily, safely, securely and efficiently.

Further, the present invention provides a gas turbine stationary blade unit wherein a diameter of said hole which said column passes through is formed larger than that of said column by a length corresponding to an overlap allowance of a hook provided at said shroud engaging with said turbine casing or said blade ring, thus, after a column is passed through a hole, a turbine casing, or a blade ring, and a shroud are movable relatively at least by a length corresponding to an overlap allowance of a hook, hence all surfaces contemplated to be overlapped of the overlap allowance of the hook are well overlapped, so that the hook may withstand a force and a moment due to pressure difference acting on the blade and the blade can be held at a predetermined position in a radial direction securely and firmly.

Further, the present invention provides a gas turbine stationary blade unit wherein a bush is inserted into an annular space formed between said hole and said column so as to fill said annular space, thus an annular space remaining between a hole and a column after a shroud etc. are moved so that an overlap allowance of a hook is overlapped securely is filled by a bush, hence a radial directional position and an axial directional position of the blade is held securely at a predetermined position and, said annular space being filled so that no space remains, there is no more fear of leaking of fluid through said space.

DESCRIPTION OF THE PREFERRED EMBODIMENTS

Figure 1:
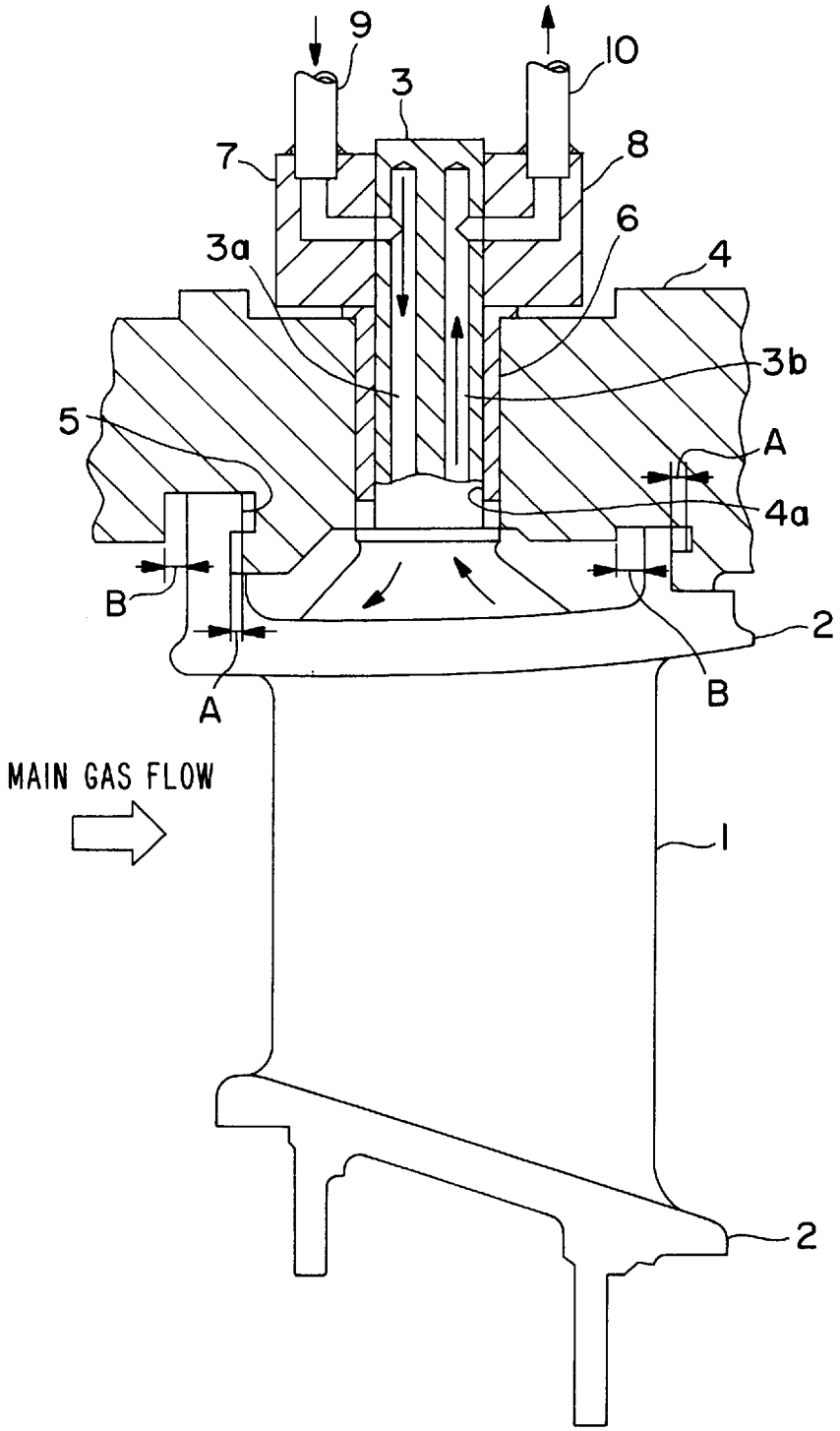
FIG. 1 is a constructional view of a stationary blade unit of one preferred embodiment according to the present invention.
Figure 2:
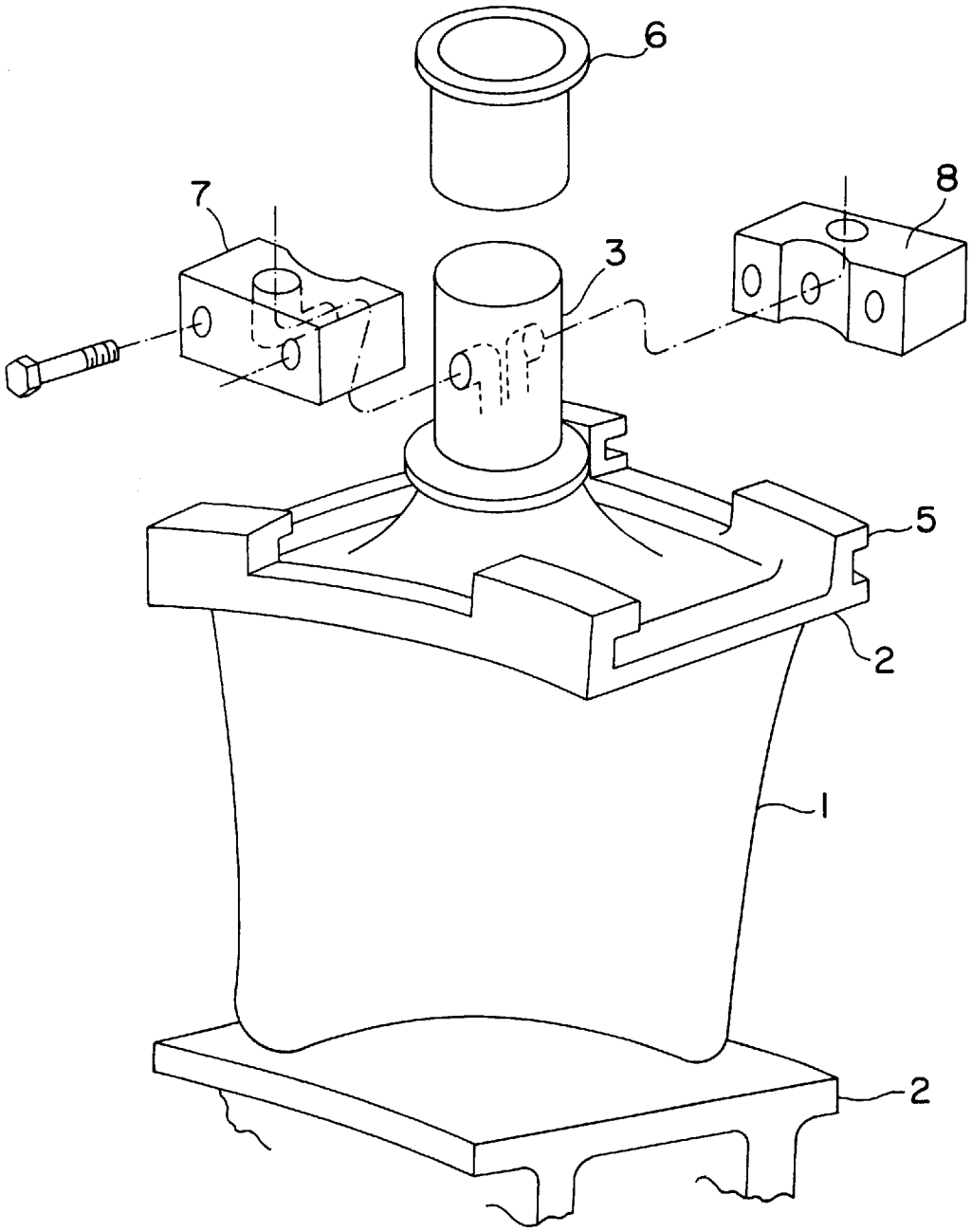
FIG. 2 is a perspective view of that shown in FIG. 1.
Figure 3:
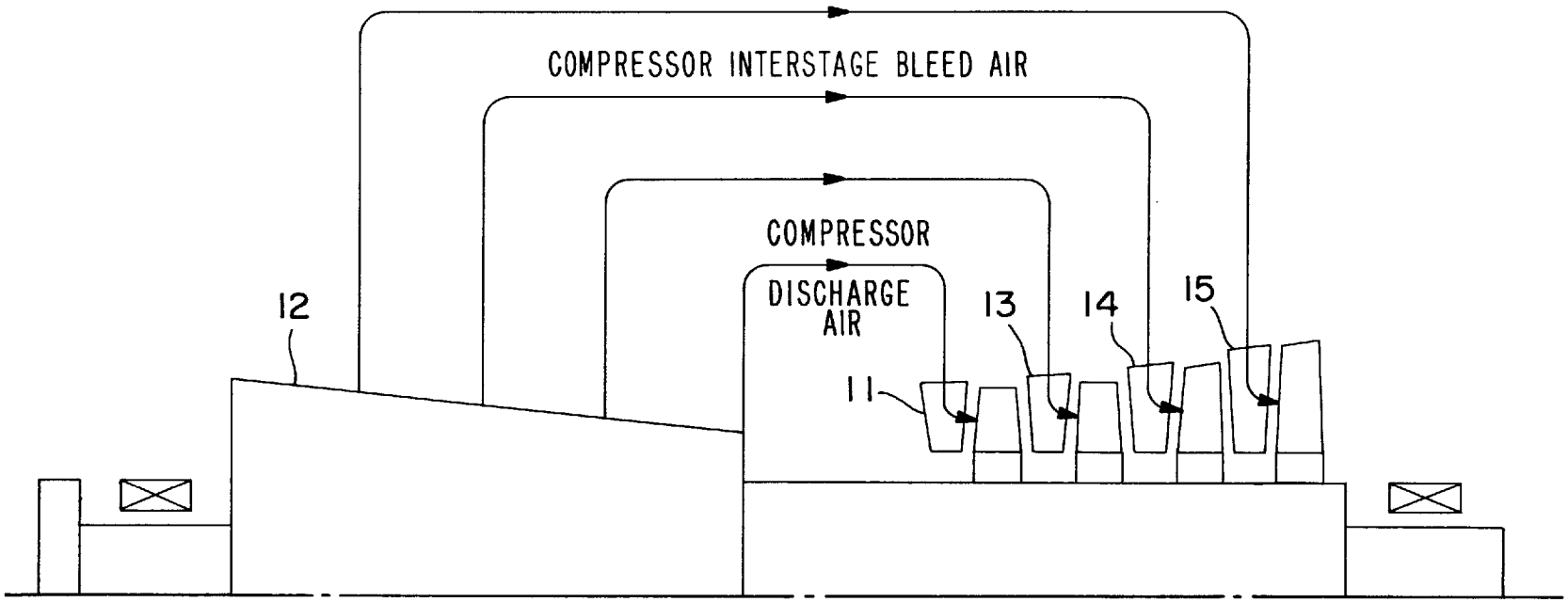
FIG. 3 PRIOR ART
FIG. 3 is a diagrammatic view showing a cooling air supply system in the prior art.

One preferred embodiment according to the present invention is described with reference to FIGS. 1 and 2. FIG. 1 is a constructional view of a stationary blade unit and FIG. 2 is a perspective view thereof.

Numeral 1 designates a stationary blade, within which there are provided cooling passages (not shown) for flow of steam employed as a cooling medium.

Numeral 2 designates a shroud provided on an outer peripheral side and an inner peripheral side, respectively, of the stationary blade 1 and, within the shroud 2, there are provided also cooling passages (not shown) for flow of steam as a cooling medium. Incidentally, according to a case, there is no need of cooling the shroud 2, in which case cooling passages of the shroud 2 may be omitted.

On the shroud 2 of the outer peripheral side, a column 3 extending in a radial direction on an outer periphery of the shroud 2 is formed integrally with the shroud 2 and, within the column 3, there are provided a supply passage 3*a* of steam as a cooling medium and a recovery passage 3*b* for recovery of the steam after used for cooling. Said supply passage 3*a* and recovery passage 3*b* are connected to said steam passages (not shown) of the stationary blade 1 and the shroud 2.

Numeral 4 designates a blade ring (incidentally, according to a stage where the stationary blade 1 is, numeral 4 designates a turbine casing, in place of the blade ring 4, and whether it is a blade ring or a turbine casing, the function and effect is same and a blade ring is described here as a representative), and a terminal end portion of the column 3 passing through a hole 4*a* made in the blade ring 4 projects on an outer peripheral side of the blade ring 4.

A diameter of said hole 4*a* is either approximately equal to a size of a diameter of the column 3 plus an overlap allowance A of a hook 5 of the shroud 2 for fixing the shroud 2 joined with the stationary blade 1 to the blade ring 4 or not less than that size, for example, a diameter of the column 3 plus B shown in the figure.

Using such construction, in order to fix the stationary blade 1 together with the shroud 2 to the blade ring 4, a terminal end portion of the column 3 is inserted into the hole 4*a* of the blade ring 4 so as to project on the opposite side and the hook 5 is hooked as the blade ring 4 is moved relatively in the axial direction, then a bush 6 is fitted into an annular space between the blade ring 4 and the column 3.

And a supply side flange 7 and a recovery side flange 8 are applied to a projected portion of the column 3 and fixed of the position so that a steam supply tube 9 provided at the supply side flange 7 and a steam recovery tube 10 provided at the recovery side flange 8 are connected to a starting end of a steam supply passage 3*a* of the column 3 and a finishing end of a steam recovery passage 3*b* of the column 3, respectively.

According to this preferred embodiment, steam as a cooling medium is securely supplied to the stationary blade 1 and the shroud 2, or to the stationary blade 1 if cooling of the shroud 2 is not necessary, and after the necessary cooling of the stationary blade 1 etc. is finished, the steam is securely recovered via the recovery passage 3*b* and the recovery tube 10, and yet the stationary blade 1 and the shroud 2 are firmly connected to the blade ring 4 etc.

In the above, the present invention was described based on the preferred embodiment shown in the figure, but the present invention is not limited to such preferred embodiment but may be added, needless to mention, with various variations in its concrete construction within a scope of the present invention.

According to the present invention, even if steam, for example, is employed as a cooling medium for cooling of a blade etc., a recovery, which becomes necessary in that case, of the cooling medium, such as steam, after used for the cooling function, is done securely and yet it is done without leakage of the cooling medium outside of the system, thereby an efficient blade cooling is done, which brings on a large contribution in enhancement of a thermal efficiency of a turbine plant.

According to the invention of claim 2, when a structural body having such cooling effect as mentioned above is being assembled and completed, work can be done at a space where a sufficient spanner space can be secured on the outer peripheral side of the blade ring etc., hence easiness, safety and reliability of work can be secured and a unit which is effective in terms both of manufacture and maintenance can be obtained.

According to the invention of claim 3, when the blade with the integrated shroud is being fitted to the blade ring etc., the overlapping of the hook can be made in the entire portion of the overlap allowance, hence the blade can well withstand a pressure and a torque reaction force, maintaining its original position of fitting and exerting a predetermined function as a stable unit.

And according to the invention of claim 4, the annular space on the outer surface of the column which has been used when the hook is overlapped is firmly filled by a bush finally, hence fixing of the blade etc. becomes further stronger and yet there is no fear of leakage of fluid, thus a stable apparatus which has a high accuracy can be obtained.

What is claimed is:

1. A gas turbine stationary blade unit comprising:

a blade;

a blade ring having a through hole;

a shroud provided on an outer periphery of said blade and connected to said blade ring;

a column extending, in a radial direction, from an outer periphery of said shroud and through said through hole formed in said blade ring, wherein said column projects outwardly of an outer peripheral surface of said blade ring;

a cooling medium supply passage formed in said column;

a cooling medium recovery passage formed in said column; and a means, connected to said column, for receiving a cooling medium supply tube and a cooling medium recovery tube such that the supply tube and the recovery tube communicate with an inlet end of said cooling medium supply passage and an outlet end of said cooling medium recovery passage, respectively.

2. The gas turbine stationary blade unit as claimed in claim 1, further comprising:

a hook provided on said shroud for securing said shroud to said blade ring; and a fixing structure, provided on said blade ring, for overlapping with said hook structure in order to fix said shroud on said blade ring, wherein said hook overlaps said structure on said blade ring by an overlap allowance, and a diameter of said through hole is larger than a diameter of said column by at least said overlap allowance.

3. The gas turbine stationary blade unit as claimed in claim 2, further comprising a bushing inserted into an annular space between an inner peripheral surface of said through hole and an outer peripheral surface of said column in order to fill said annular space.

4. The gas turbine stationary blade unit as claimed in claim 1, wherein said cooling medium supply passage is adapted to supply cooling medium to flow within said blade and said shroud, and said cooling medium recovery passage is adapted to recover the cooling medium supplied in said blade and said shroud.

5. The gas turbine stationary blade unit as claimed in claim 1, wherein said cooling medium supply passage is adapted to supply cooling medium to flow within said blade, and said cooling medium recovery passage is adapted to recover the cooling medium supplied in said blade.

6. A gas turbine stationary blade unit comprising:

a blade;

a turbine casing having a through hole;

a shroud provided on an outer periphery of said blade and connected to said turbine casing;

a column extending in a radial direction from an outer periphery of said shroud and into said through hole formed in said turbine casing, wherein said column projects outwardly of an outer peripheral surface of said turbine casing;

a cooling medium supply passage formed in said column;

a cooling medium recovery passage formed in said column; and a means, connected to said column, for connecting a supply tube and a recovery tube to an inlet end of said cooling medium supply passage and an outlet end of said cooling medium recovery passage, respectively.

7. The gas turbine stationary blade unit as claimed in claim 6, further comprising:

a hook provided on said shroud for securing said shroud to said turbine casing; and a structure provided on said blade ring for overlapping with said hook structure in order to fix said shroud on said turbine casing, wherein said hook overlaps said structure on said turbine casing by an overlap allowance, and a diameter of said through hole is larger than a diameter of said column by at least said overlap allowance.

8. The gas turbine stationary blade unit as claimed in claim 7, further comprising a bushing inserted into an annular space between an inner peripheral surface of said through hole and an outer peripheral surface of said column in order to fill said annular space.

9. The gas turbine stationary blade unit as claimed in claim 6, wherein said cooling medium supply passage is adapted to supply cooling medium to flow within said blade and said shroud, and said cooling medium recovery passage is adapted to recover the cooling medium supplied in said blade and said shroud.

10. The gas turbine stationary blade unit as claimed in claim 6, wherein said cooling medium supply passage is adapted to supply cooling medium to flow within said blade, and said cooling medium recovery passage is adapted to recover the cooling medium supplied in said blade.

* * * * *